US005332323A

United States Patent [19]

Murai et al.

[11] Patent Number: 5,332,323

[45] Date of Patent: Jul. 26, 1994

[54] PAPER INSERT DEVICE FOR PRINTER

[75] Inventors: Shunji Murai, Chita; Satoshi Yanagisawa, Aichi, both of Japan

[73] Assignee: Brother Kogyo Kabushiki Kaisha, Nagoya, Japan

[21] Appl. No.: 959,542

[22] Filed: Oct. 13, 1992

[30] Foreign Application Priority Data

Feb. 24, 1992 [JP] Japan ..... 4-017395[U]

[51] Int. Cl.[5] ..... B41J 11/50; B41J 13/10

[52] U.S. Cl. ..... 400/605; 400/642; 400/647; 400/600

[58] Field of Search ..... 400/605, 616.1, 616.2, 400/616.3, 603, 603.1, 690.4, 595, 642, 647, 647.1, 600

[56] References Cited

U.S. PATENT DOCUMENTS

| | | | |
|---|---|---|---|
| 2,670,833 | 3/1954 | Metzner | 400/616 |
| 4,576,578 | 3/1986 | Parker et al. | 400/682 |
| 4,995,745 | 2/1991 | Yokoi et al. | 400/605 |
| 5,033,890 | 7/1991 | Niikawa | 400/605 |
| 5,082,382 | 1/1992 | Negoro et al. | 400/619 |

FOREIGN PATENT DOCUMENTS

| | | | |
|---|---|---|---|
| 0073972 | 4/1987 | Japan | 400/605 |
| 0138267 | 6/1987 | Japan | 400/605 |
| 62-201281 | 9/1987 | Japan . | |
| 0231965 | 9/1988 | Japan | 400/605 |

*Primary Examiner*—Edgar S. Burr
*Assistant Examiner*—Anthony Nguyen
*Attorney, Agent, or Firm*—Oliff & Berridge

[57] ABSTRACT

The invention is for a paper insert device for a printer having a tractor cover for openably covering an opening before a tractor, a cut paper guide located above the tractor and behind an opening for manual insertion of a cut paper, and a manual insert cover for openably covering the opening. The manual insert cover is substantially flush with the cut paper guide when open.

14 Claims, 7 Drawing Sheets

PAPER INSERT DEVICE FOR PRINTER

BACKGROUND OF THE INVENTION

1. Field of the Invention

The invention relates to a paper insert device for a printer having a front surface provided with a first opening for manual insertion of cut paper, a second opening for setting of continuous paper and having a tractor located behind the second opening for feeding the continuous paper.

2. Description of Related Art

In a conventional printer having a front surface provided with an opening for manual insertion of cut paper, the cut paper is manually inserted from the opening in a substantially horizontal direction to be fed Into the printer. One such conventional printer is not provided with a cover for covering the opening provided for manual insertion. In another such printer, there is provided a cover but the cover merely serves to cover the opening. That is, the cover does not serve as a paper supporter for supporting the cut paper when the cover is open, for example.

A printer capable of feeding continuous paper in addition to manual feeding of the cut paper has also been proposed. Such a printer is provided with a tractor for feeding the continuous paper fed through an opening through the front surface of the printer. In this kind of printer, a cover for covering the opening for setting the continuous paper is also commonly used as the cover for covering the opening provided for the manual insertion of the cut paper.

However, the paper insert device for the printers in the art as described has the following problems.

In the printer having the cover for covering the opening provided for the manual insertion of the cut paper, the cover is short in length, so that it cannot function to support the cut paper to be inserted. Accordingly, a user must manually support the cut paper even after initially setting the same making the insert operation troublesome.

In the printer having the tractor for feeding the continuous paper, when the cut paper is used, the opening for setting the continuous paper is uncovered, while when the continuous paper is used, the opening provided for the manual insertion of the cut paper is uncovered. Accordingly, operation noise of a print head or the like escapes from the uncovered opening to the outside of the printer, thus interfering with the work of persons in the area.

SUMMARY OF THE INVENTION

It is an object of the invention to provide a paper insert device for a printer which can reduce the operation noise escaping from an opening provided for the manual insertion of cut paper and an opening provided for the setting of continuous paper and, at the same time, simplifies the insert operation for the cut paper.

According to the invention, there is provided a paper insert device for a printer having a front surface provided with a first opening for the manual insertion of cut paper, a second opening for the setting of continuous paper, and having a tractor located behind the second opening for feeding the continuous paper, the paper insert device comprising: a tractor cover for openably covering the second opening; a cut paper guide located above the tractor and behind the first opening for guiding the cut paper inserted from the first opening; and a cut paper supporter for openably covering the first opening and supporting the cut paper to be fed to the cut paper guide, the cut paper supporter being substantially flush with the cut paper guide in an open condition of the cut paper supporter.

It is preferable that the tractor cover and the cut paper supporter are coaxially supported.

In the paper insert device for the printer according to the invention having the above structure, when manually inserting the cut paper, the cut paper supporter is opened to become substantially flush with the cut paper guide provided in the printer. Accordingly, the cut paper is manually slid on the cut paper supporter to be fed to the cut paper guide. Thereafter, the cut paper is drawn to a printing section located behind the cut paper guide. During printing of the cut paper, the tractor cover is closed thereby reducing the escape of operation noise.

On the other hand, in the case of printing the continuous paper while being fed by the tractor, the cut paper supporter is closed to thereby minimize the escape of operation noise. During insertion, or feeding of the continuous paper, the tractor cover is opened thereby exposing the tractor to the outside of the printer. In this open condition, the continuous paper can be set simply and securely.

Both the opening provided for the manual insertion of cut paper and the opening for setting the continuous paper can be effectively and widely formed. Further, a support shaft for the cut paper supporter and a support shaft for the tractor cover can be provided as a single common shaft and, accordingly, both the openings may be defined by partitioning a single opening by the single common shaft. Therefore, the structure of the paper insert device can be simplified.

As is apparent from the above description, the paper insert device for the printer according to the invention has the following superior effects:

(1) The escape of operation noise from the opening for manual insertion of the cut paper and the opening for setting the continuous paper can be reduced. Further, since the cut paper can be placed on the paper supporter during manual insertion of the cut paper, the insertion, or feeding, operation of the cut paper is easier.

(2) Both the opening for manual insertion of the cut paper and the opening for setting of the continuous paper can be widely formed to provide for convenience in handling. Further, as the support shaft for the paper supporter and the support shaft for the tractor cover can be made common, the structure of the paper insert device may be simplified.

DETAILED DESCRIPTION OF THE PREFERRED EMBODIMENTS

A preferred embodiment of the invention will now be described with reference to the drawings.

Figure 1:
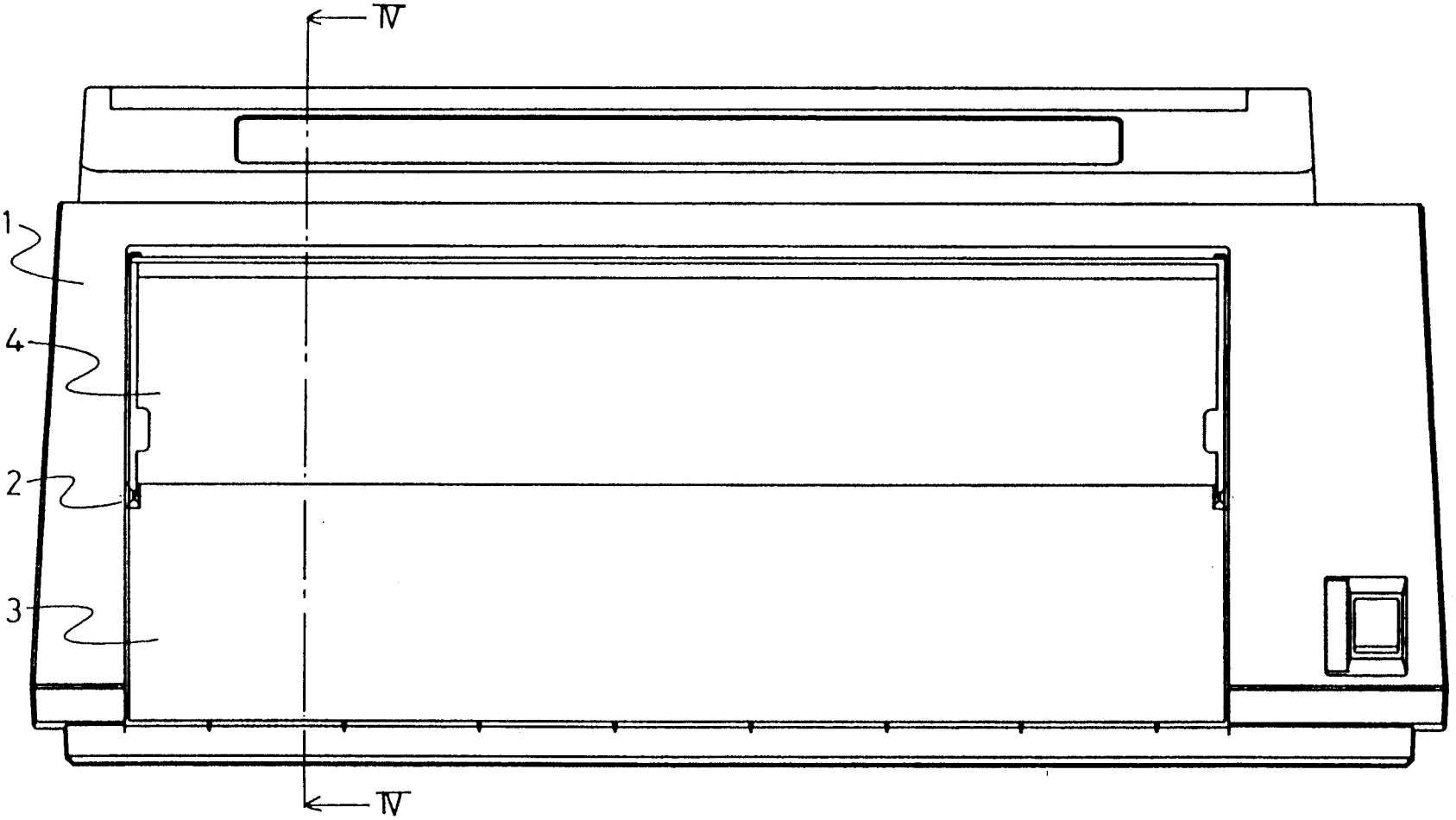
FIG. 1 is a front view of a printer having both a cut sheet opening and a continuous sheet opening closed by covers.
Figure 2:
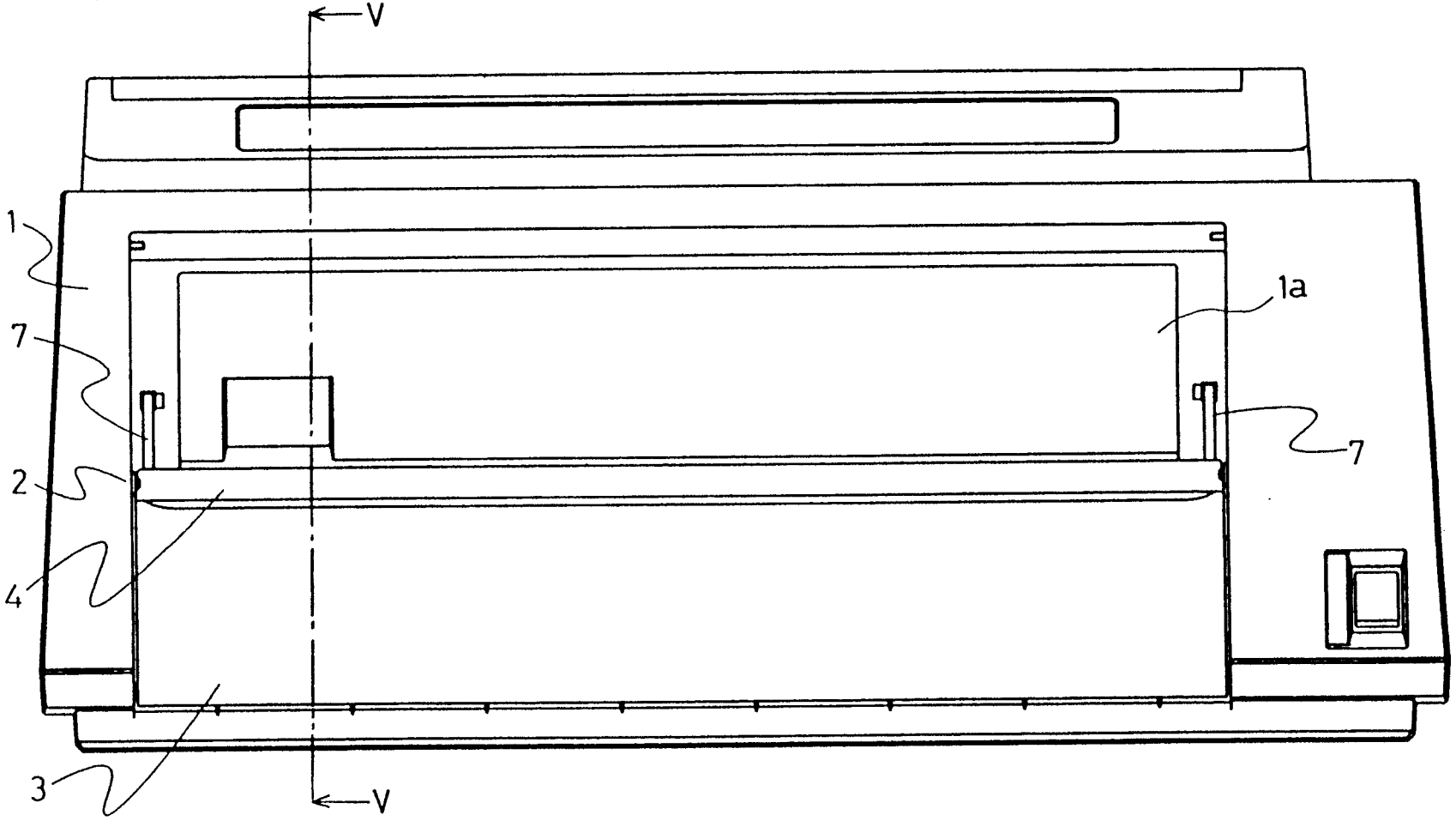
FIG. 2 is a front view of the printer with the cut sheet opening open.
Figure 3:
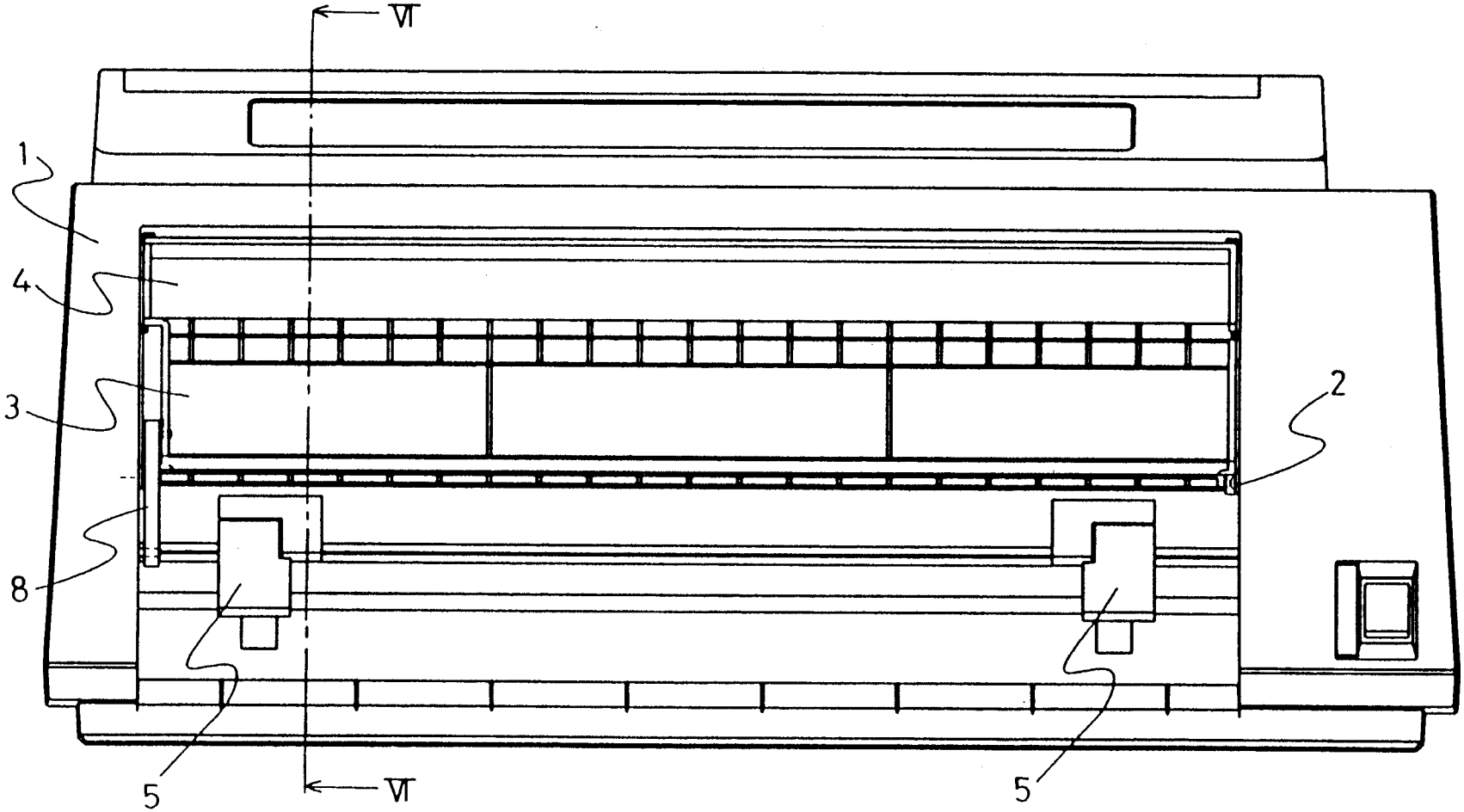
FIG. 3 is a front view of the printer with the continuous sheet opening open.

FIGS. 1, 2 and 3 show the front of a printer with the covers over the openings for both the cut sheets and continuous sheets, the cover for the cut sheets open and the cover for continuous feed paper open, respectively.

Figure 4:
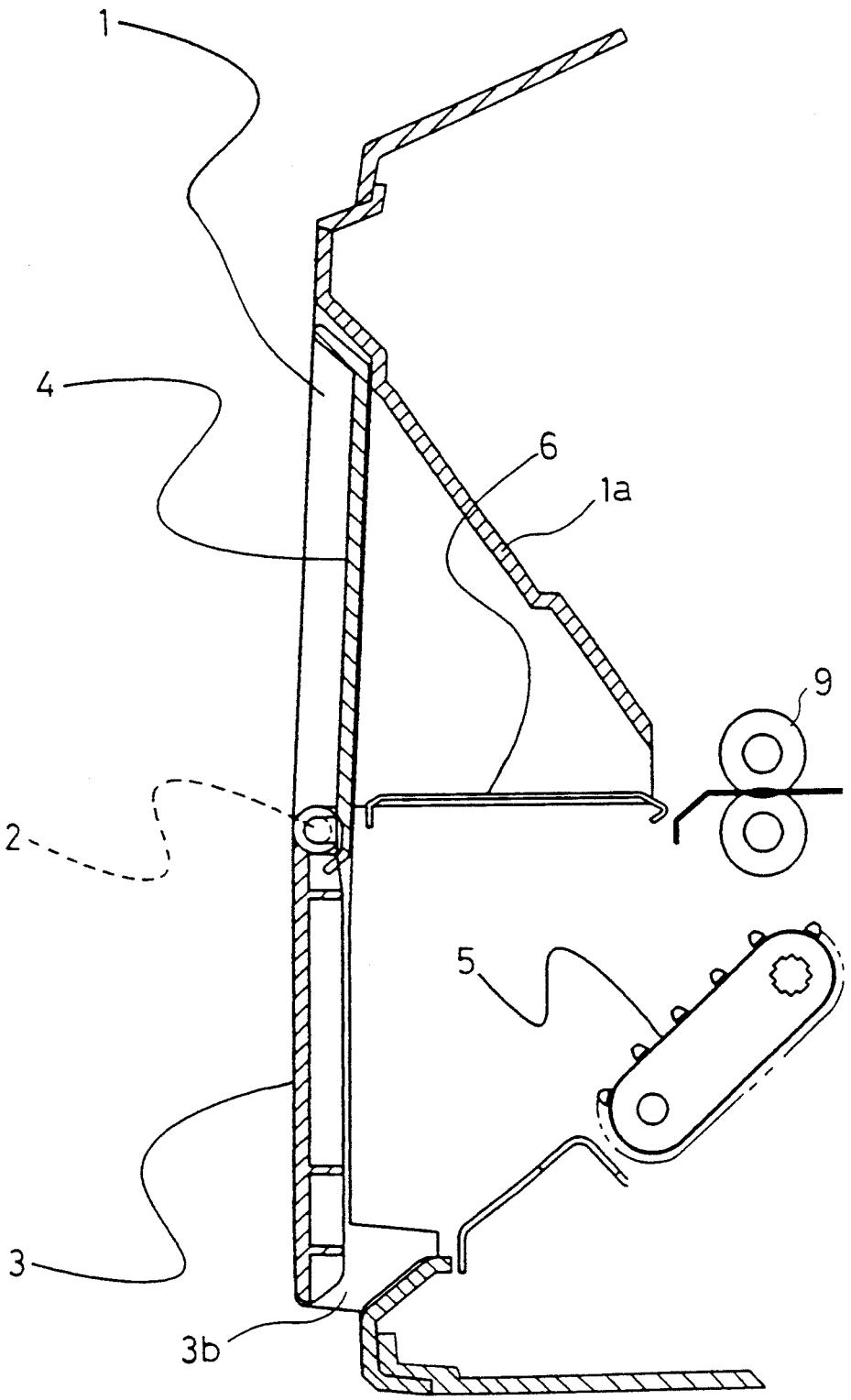
FIG. 4 is a sectional side view, along line IV—IV of FIG. 1, of a paper insert device for a printer in a preferred embodiment according to the invention.
Figure 5:
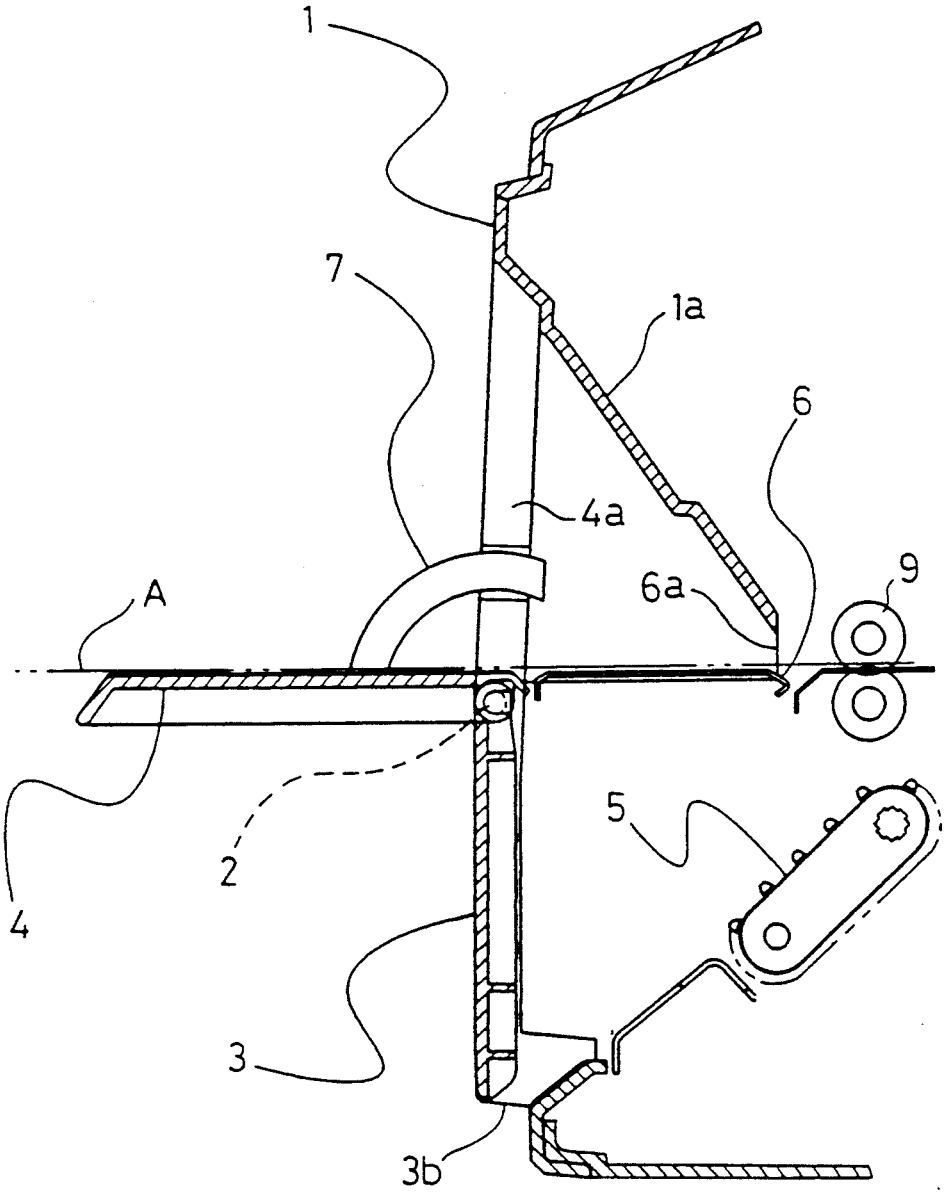
FIG. 5 is a sectional side view, along line V—V of FIG. 2, illustrating insert operation of cut paper used in the paper insert device shown in FIG. 1.
Figure 6:
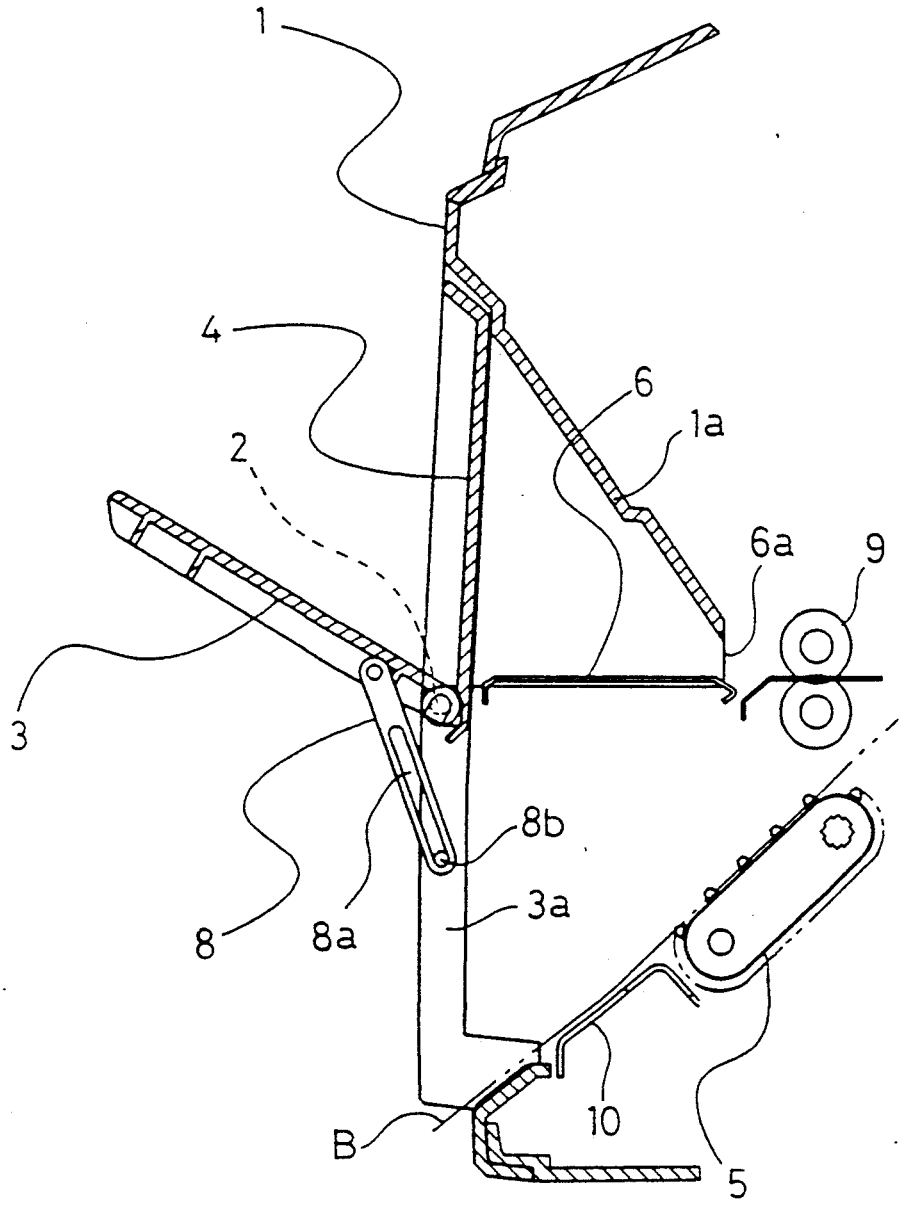
FIG. 6 is a sectional side view, along line VI—VI of FIG. 3, illustrating the setting operation of continuous paper used in the paper insert device shown in FIG. 4.
Figure 7:
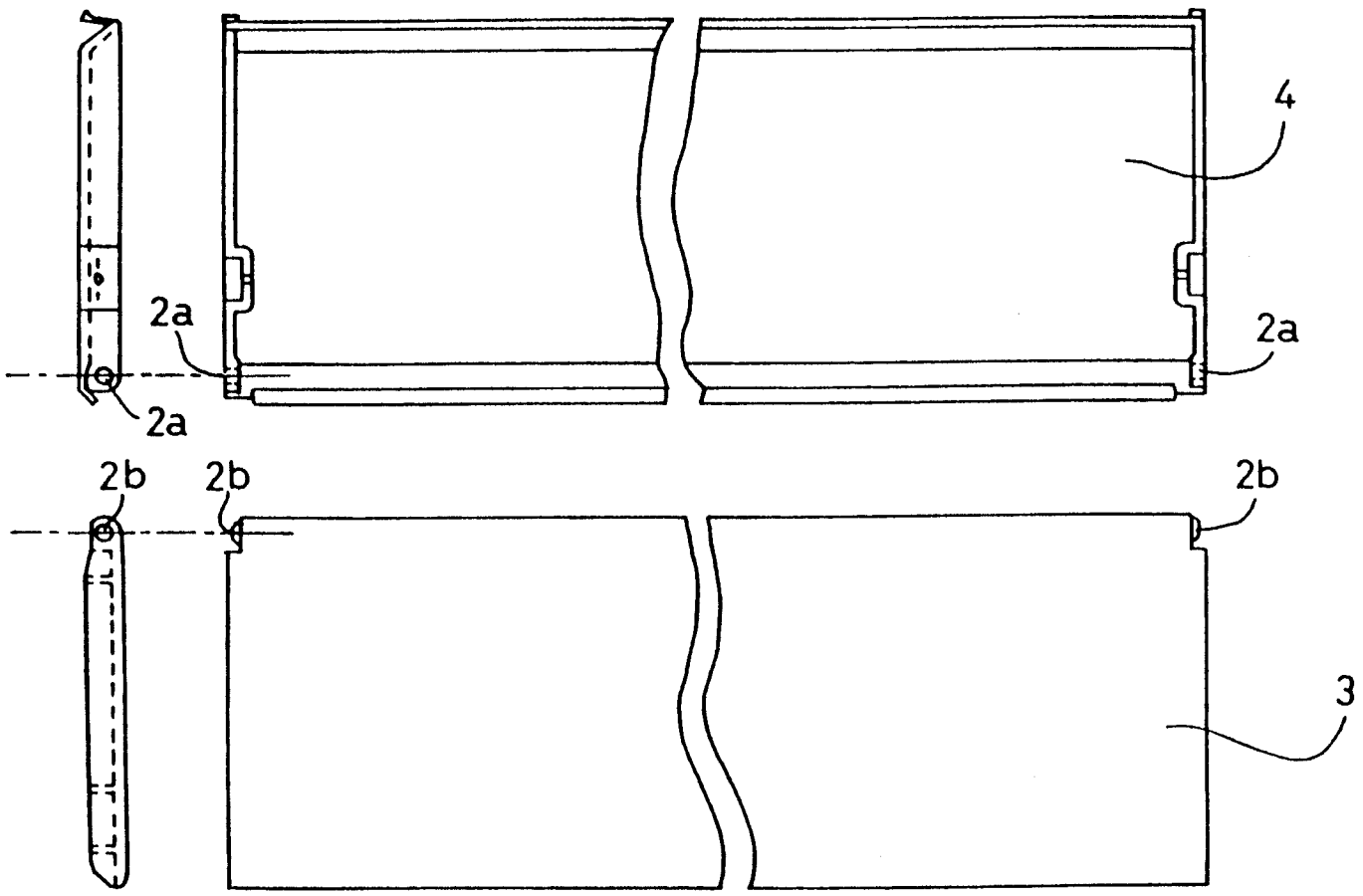
FIG. 7 shows the relationship of the cover for the continuous sheet opening to the cover for the cut sheet opening.

FIG. 4 is a sectional side view of a paper insert device for a printer in the preferred embodiment according to the invention, FIG. 5 is a sectional side view illustrating the insert operation of cut paper in the case where the cut paper is used, and FIG. 6 is a sectional side view illustrating the setting operation of continuous paper in the case where the continuous paper is used.

As shown in FIG. 5, a front cover 1 covering a front surface of the printer is provided with an opening 4*a* for allowing cut paper A to be manually inserted therethrough. Support stubs 2 extend horizontally from opposed lateral ends of the front cover 1 at a lower end of the opening 4*a* to engage openings 2*a* in a manual insert cover 4. The manual insert cover 4, for covering the opening 4*a*, is pivotally supported to the support stubs 2 so as to be opened forward and downward to a horizontal position. The support stubs 2, as stated, extend from the sides of the opening 4*a* (FIG. 1).

As shown in FIG. 6, the front cover 1 is also provided with an opening 3*a* below the opening 4*a* for allowing continuous paper B to be set and fed in the case of continuous paper feed. A tractor cover 3 for covering the opening 3*a* is pivotally supported by the openings 2*a* of manual insert cover 4 by cover stubs 2*b*, so as to be opened forward and upward to a horizontal position. A support stub 2 and cover stub 2*b* oppose each other in the opening 2*a* on either side of manual insert cover 4.

As shown in FIGS. 2 and 5, the manual insert cover 4 is held in the forward open condition, that is, in the horizontal position during insertion of the cut paper A so that the manual insert cover 4 may also serve as a paper supporter for placing the cut paper A thereon. To hold the manual insert cover 4 in the horizontal position, a pair of arcuate guide members 7 are fixed at their front ends to opposite lateral ends of the manual insert cover 4. In the horizontal position of the manual insert cover 4, the rear ends of the guide members 7 are engaged with rear surfaces of opposite side portions of the front cover 1. Thus, the manual insert cover 4 is held in the horizontal position when open and in a vertical position when closed, i.e., when the opening 4*a* is covered. In the closed position, the guide members 7 are received inside the printer.

A cut paper guide 6 is provided within the printer so as to horizontally extend inward from the manual insert cover 4 in such a manner that the cut paper guide 6 is substantially flush with and substantially continuous from the manual insert cover 4 when in the horizontal position. The guide members 7 are seated on each side of the cut paper guide 6 when the manual insert cover is closed.

Further, a portion 1*a* of the front cover 1 extends obliquely downward toward a rear end of the cut paper guide 6. A slit 6*a*, which allows passage of the cut paper A therethrough, is defined between a free end of the portion 1*a* and the rear end of the cut paper guide 6. The slit 6*a* is defined by inclining the portion 1*a* of the front cover 1 so as to suppress operation noise generated in the printer from escaping to the outside of the printer during insertion (use) of the cut paper A. A feed roller 9 is located behind the cut paper guide 6 and a printing section (not shown) having a dot print head is located behind the feed roller 9. The cut paper A printed in the printing section is delivered to a stacker (not shown) provided at a rear portion of the printer.

As shown in FIGS. 3 and 6, in the forward open condition of the tractor cover 3, it is held in a somewhat upward inclined position. To hold the tractor cover 3 in this position, a pair of rocker arms 8 are pivotally mounted at their upper ends to opposite lateral ends of the tractor cover 3. Each of the rocker arms 8 is provided with a longitudinally elongated slide hole 8*a*. A pair of projections 8*b* are protrusively provided on the opposed lateral ends of the front cover 1. The slide holes 8*a* of the rocker arms 8 are slidably engaged with the projections 8*b* of the front cover 1, respectively.

To retain tractor cover 3 in an open position, the longitudinally elongated slide holes 8*a* are provided with a catch at the end away from tractor cover 3. One such catch is to have the longitudinally elongated slide hole 8*a* extend from a widest point near where the rocker arm 8 is attached to tractor cover 3 to a narrowest point near the end furthest from tractor cover 3. At the point closest to tractor cover 3, the longitudinally elongated slide hole 8*a* is at least as wide as projection 8*b* and tapers to become slightly narrower than projection 8*b*. At the end of the longitudinally elongated slide hole 8*a*, away from the tractor cover 3, is provided a bottom hole which has substantially the same diameter as projection 8*b*. Thus, when the cover is opened, the longitudinally elongated slide hole 8*a* is expanded slightly to allow passage of projection 8*b* until projection 8*b* engages the bottom hole. At that time, the sides of the longitudinally elongated slide hole 8*a* return to their normal position providing a catch so that the tractor cover 3 is held in an open position. When a lower end of each longitudinally elongated slide hole 8*a* is in the position of the corresponding projection 8*b*, as shown in FIG. 6, i.e., in the base hole, the tractor cover 3 is held in the open condition thereof to thereby uncover the opening 3*a*. To close tractor cover 3, a slight pressure is applied to the upper surface of the tractor cover 3 thereby forcing the constricted portion of each longitudinally elongated slide hole 8*a*, immediately above the bottom hole, to expand thereby permitting passage of projection 8*b* along the longitudinally elongated slide hole 8*a*.

A continuous paper guide 10 is provided within the printer behind the opening 3*a* so as to extend obliquely upward, from a lower end portion of the front cover 1, and a tractor 5, for feeding the continuous paper B, is located behind the continuous paper guide 10 so as to be substantially flush with the continuous paper guide 10. After setting the continuous paper B onto the tractor 5 in the open condition of the tractor cover 3, as shown in FIGS. 3 and 6, the tractor cover 3 is closed, as shown in FIGS. 1 and 4, and the continuous paper B is fed by the tractor 5 to the printing section where it is printed. To carry out printing of the continuous paper B in the closed condition of the tractor cover 3 as mentioned above, a slit 3*b* for allowing the passage of the continuous paper B therethrough is defined between a lower end of the tractor cover 3 in the closed condition and the lower end portion of the front cover 1. After printing the continuous paper B in the printing section, the continuous paper B is ejected from the rear portion of the printer. In the case of printing the continuous paper B, not only the tractor cover 3 but also the manual insert cover 4 is closed to thereby minimize the escape of operation noise from the printer.

Although both the manual insert cover 4 and the tractor cover 3 are commonly supported on the support stubs 2 in the above preferred embodiment, the supporting structure for both the covers 3 and 4 is not limited to the above. For example, a common support shaft could be used.

What is claimed is:

1. A paper insert device for a printer, comprising:

a front wall provided with a first opening for manual insertion of cut paper;

a second opening for setting of continuous paper;

a tractor located behind said second opening for feeding the continuous paper;

a tractor cover for operably covering said second opening, said tractor cover pivotally supported for opening and closing so as to permit setting of the continuous paper to said tractor when said tractor cover is open;

a cut paper guide located above said tractor and behind said first opening for guiding the cut paper inserted from said first opening;

a cut paper supporter for operably covering said first opening and supporting the cut paper to be fed to said cut paper guide in an open condition of said cut paper supporter; and a common support shaft, said tractor cover pivotally supported by said common support shaft to allow opening and closing of said tractor cover and said cut paper supporter pivotally supported by said common support shaft to allow opening and closing of said cut paper supporter.

2. The paper insert device as defined in claim 1, wherein said cut paper supporter is substantially flush with said cut paper guide in the open condition of said cut paper supporter.

3. A printer, comprising:

a front wall having a first opening for allowing insertion of cut paper therefrom and a second opening for allowing insertion of continuous paper therefrom;

a cut paper guide located behind said first opening for guiding the cut paper inserted from said first opening;

a continuous paper guide located behind said second opening for guiding the continuous paper inserted from said second opening;

a first cover for operably covering said first opening and supporting the cut paper to be fed when in an open condition and said first cover is substantially an aligned extension of said cut paper guide;

a second cover for operably covering said second opening, said second cover pivotally supported for opening and closing to permit setting the continuous paper to said continuous paper guide when said second cover is open; and support means for pivotally supporting both said first cover and said second cover for opening and closing thereof.

4. The printer as defined in claim 3, further comprising a projection formed on said front wall and an arm member pivotally mounted at one end thereof to said second cover, said arm member having an elongated slide hole slidably engaged with said projection of said front wall and a retention hole at a second end for retainably engaging said projection.

5. The printer as defined in claim 3, wherein a slit for allowing passage of the continuous paper therethrough to said continuous paper guide is defined between said front wall and said second cover in a closed condition thereof.

6. A noise abatement device for a printer, comprising:

a pair of openings in a front surface, a first opening for manually feeding cut paper sheets and a second opening for setting and feeding continuous feed paper to a printhead;

a manual feed cover for covering the first opening for manually feeding the cut paper sheets;

a continuous feed cover for covering the second opening for setting and feeding continuous feed paper, said continuous feed cover pivotally supported for opening and closing to permit setting of the continuous paper when said continuous feed cover is open;

support means for pivotally supporting both said manual feed cover and said continuous feed cover;

a cut paper sheet guide mounted in the printer adjacent the first opening for manually feeding the cut paper sheets; and a continuous paper sheet guide mounted in the printer adjacent to the second opening for setting and feeding continuous feed paper, wherein said manual feed cover when in an open position provides a sheet insertion tray that is aligned with said cut paper sheet guide.

7. The noise abatement device as claimed in claim 6, wherein said support means comprises a common support shaft that pivotally supports said manual feed cover and said continuous feed cover.

8. The noise abatement device as claimed in claim 7, wherein said common support shaft comprises a stub extending from each side of said first opening for manually feeding the cut paper sheets and a paired abutting stub extending from each side of said continuous feed cover, each pair of abutting stubs having pivotally mounted thereon said manual feed cover by means of a hole in each side of said manual feed cover.

9. The noise abatement device as claimed in claim 6, further comprising retention means for holding said continuous feed cover in an open position.

10. The noise abatement device as claimed in claim 9, wherein said retention means comprises a pair of rocker arms, each rocker arm having two ends, one end of each said rocker arm pivotally mounted to a side of said continuous feed cover, and an elongated slot extending to a retention hole at a second end, said retention hole engaging a projection extending from the side edge of the opening for setting and feeding continuous feed paper.

11. The noise abatement device as claimed in claim 6, wherein the manual feed covering further comprises retention means for engaging side edges of the first opening for manually feeding cut paper sheets to hold said manual feed cover in position as a cut paper sheet insertion tray when said manual feed cover is opened.

12. The noise abatement means as claimed in claim 6, further comprising a tractor feed positioned adjacent said continuous paper sheet guide on a side opposite of said continuous paper sheet guide from said second opening for setting and feeding continuous paper feed, said continuous paper sheet guide and said tractor feed defining an inclined path from a bottom of said second opening for setting and feeding continuous feed paper toward a paper feed path internal to the printer, said inclined path providing a first noise baffle.

13. The noise abatement means as claimed in claim 12, wherein when said continuous feed cover is closed, a gap exists between a side of the continuous feed cover opposite that side pivotally mounted to said support means and an opposing edge of the second opening for setting and feeding continuous feed paper, said gap permitting continuous feed paper to be fed into the printer during operation.

14. The noise abatement means as claimed in claim 6, further comprising an extension of the front surface of the printer, said extension extending at an angle toward a point separated from a side of said cut paper sheet guide opposite to where said cut paper sheet guide is mounted adjacent to the first opening for manually feeding the cut paper sheets, said extension providing a second noise baffle.

* * * * *